US005452800A

United States Patent [19]

Muir

[11] Patent Number: 5,452,800

[45] Date of Patent: Sep. 26, 1995

[54] ROOFING ASPHALT PACKAGING AND METHOD

[75] Inventor: Raun S. Muir, Woods Cross, Utah

[73] Assignee: Petro Source Refining Partners, Houston, Tex.

[21] Appl. No.: 170,680

[22] Filed: Dec. 20, 1993

Related U.S. Application Data

[63] Continuation of Ser. No. 974,608, Nov. 12, 1992, abandoned, which is a continuation of Ser. No. 682,192, Apr. 8, 1991, abandoned.

[51] Int. Cl.[6] ..... B65D 57/00

[52] U.S. Cl. ..... 206/447; 206/524.3; 206/524.7

[58] Field of Search ..... 206/447, 524.3, 206/524.4, 524.5, 524.7, 504, 813; 428/35.1, 35.2, 35.5, 36.91; 53/502, 469

[56] References Cited

U.S. PATENT DOCUMENTS

| | | | |
|---|---|---|---|
| 1,565,798 | 12/1925 | Dillehay et al. | 206/447 |
| 2,572,959 | 10/1951 | Sparks et al. | 206/447 |
| 2,762,504 | 9/1956 | Sparks et al. | 206/447 |
| 2,791,327 | 5/1957 | Sparks et al. | 206/447 |
| 2,804,205 | 8/1957 | Barton et al. | 206/524.3 |
| 2,964,176 | 12/1960 | Harrmann . | |
| 3,314,211 | 4/1967 | Wolff | 206/447 |
| 3,366,233 | 1/1968 | Roediger | 206/524.3 |
| 3,648,882 | 3/1972 | Shelton | 206/447 |
| 3,837,778 | 9/1974 | Parker | 206/524.7 |
| 4,073,760 | 2/1978 | Harris et al. | 206/524.7 |
| 4,112,158 | 9/1978 | Creekmore et al. | 206/447 |
| 4,318,475 | 3/1982 | Robinson . | |
| 4,335,560 | 6/1982 | Robinson . | |
| 4,365,710 | 12/1982 | Swanson | 206/813 |
| 4,378,067 | 3/1983 | Butler et al. | 428/35.5 |
| 4,450,962 | 5/1984 | Matthews et al. | 206/447 |

FOREIGN PATENT DOCUMENTS

| | | | |
|---|---|---|---|
| 90324 | 8/1978 | Japan | 206/524.7 |

*Primary Examiner*—David T. Fidei
*Attorney, Agent, or Firm*—Tobor & Goldstein

[57] ABSTRACT

A packaging for roofing asphalt comprising a polypropylene film 1.0 to 1.8 mils thick with a melting point between 275° F. and 335° F. as the sole containment, and a method for manufacturing the same are disclosed.

2 Claims, 3 Drawing Sheets

ROOFING ASPHALT PACKAGING AND METHOD

This application is a continuation of application Ser. No. 974,608, filed Nov. 12, 1992, now abandoned, which is a continuation of application Ser. No. 682,192, filed Apr. 8, 1991, now abandoned.

FIELD OF THE INVENTION

This invention relates to a new packaging for asphalt, particular for roofing asphalt.

BACKGROUND OF THE INVENTION

Roofing asphalt, although solid at room-temperature requires a packaging for shipping and storage, because it is tacky and will adhere to most things it touches. Typically, asphalt for use in roofing is packaged for shipping in large fiberboard cylinders with metal ends containing from 100 to 170 pounds of asphalt. When delivered to a job site, the metal ends are removed, the fiberboard packaging torn and cut off with a roofing knife, and the asphalt is broken up with a hatchet in order to get the asphalt into smaller pieces for insertion into an asphalt vat for melting. The discarded fiberboard packaging material is then cleaned up and disposed of.

The discarded waste fiberboard, in addition to representing lost cleaning time by the roofer, also represents a poor use of natural resources. The number of trees required to make a years consumption of this fiberboard is in the thousands. Furthermore, the fiberboard is treated with silicon which precludes its use in recycled paper and it must be discarded in a land fill.

There is considerable time spent in the preparation, melting of the asphalt, and the cleanup. In addition, all of the packaging material must be removed from the asphalt before it is put into the melting vat, otherwise it becomes incorporated as solid contamination, which interferes with the pumping and the application of the asphalt. Another problem of the conventional packaging is that the cylindrical shape makes it difficult to palletize the asphalt packages for shipping and storage, and the packages do not pack closely together, resulting in wasted storage space.

There have been some packaging systems proposed comprising a packaging material which is not removed from the asphalt when it is added to the vat for melting. The packaging material is presumably melted with the asphalt. The problem is that high strength materials are required, so that they can contain molten asphalt as it is poured into a container or mold during the packaging operation. This conflicts with the requirement that the packaging completely melts into the asphalt in the asphalt vat when the asphalt is used at the job-site. The problem is further aggravated by the fact that the asphalt vats are relatively small portable units which can be transported to the job-site, and the asphalt is melted and applied relatively quickly. Thus, there is not the heating capacity and time to allow slow-melting materials to completely melt. Materials which melt readily in the asphalt vat have been used as packaging materials, but these also soften and melt during the initial packaging operation and require additional non-melting and reinforcing packaging to provide the packaging strength. This non-melting component, usually a fiberboard, must then be stripped before the asphalt is melted. Thus, the prior art packaging systems suffer either from the requirement of having to strip packaging from the asphalt, or from the problem of nonmelted or partially melted materials in the asphalt melt in the asphalt vat at the job-site.

U.S. Pat. No. 3,837,778 discloses a packaging system for roofing asphalt wherein molten asphalt is poured into a mold lined with a polyester film to form an asphalt brick covered with the polyester film. The polyester-film covered bricks can then be placed into a asphalt vat without removing the film. At col. 5, lines 43 to 44, it is disclosed that the " . . film is incorporated into the entire bulk or mass of asphalt without any deleterious effect thereto. (at least in low concentration)" The specific film used in this reference softens or weakens at 440° F. (col. 6, lines 10 to 17), and is a polyester, i.e. Mylar™ polyethylene terephthalate resin. Other films may be used if they have a softening point between the requisite range, above about 375° F. to about 480° F., preferably between about 440° F. and 480° F. (See col. 5 lines 52 to col. 6, line 55)

A problem with this system is that the films disclosed have high melting or softening points, which are at or near the temperature typically used in roofing asphalt vats, between 440° F. and 525° F. Accordingly when a polyester-film covered asphalt brick is placed in the vat, the film may soften and weaken to release the asphalt but it does not completely melt and become incorporated into the melted asphalt mass before the asphalt is used. While this reference did disclose that the film in small concentration is not deleterious, it has been found that the presence of unmelted films in the vat does cause some deterioration as a solid contaminant. As mentioned above, such solid contaminants can cause deterioration of the asphalt quality and difficulties in pumping and applying the asphalt. In addition, the unmelted films tend to ball up in the vat, further inhibiting their melting. The unmelted films accumulate in the asphalt vat, and result in deterioration in the function of the vat, a lowered heating rate and even clogging of the conduits of the vat.

In U.S. Pat. Nos. 4,318,475 and 4,335,560 an asphalt container is disclosed which includes a rigid cardboard container having a bag shaped liner for containing the molten asphalt as it is poured into the container. The bag is designed to become molten in a range between 250° F. and 285° F. Since the temperature of melted asphalt being poured into the bag during packaging (above about 225° F.) is usually near the melting temperature of the bag, the plastic bag is softened and is fully or partially melted during the initial packaging. The bag, therefore, has insufficient strength to contain the asphalt. For this reason, a rigid cardboard container is required to provide the physical strength. This system, therefore, still requires the stripping of a packaging from the asphalt, and does not solve the waste problem.

In U.S. Pat. No. 3,366,233 discloses a packaging for paving asphalt having low softening point, between about 80° F. and 140° F. The packaging is a multilayered or laminated film between 2 and about 6 mils. Each layer is a alpha olefin having a melt index below about 12 when measured at 230° C. (446° F.). The olefin may be polyethylene, polypropylene, or a copolymer of ethylene with polypropylene. The packaging of this reference is for low softening point materials which do not resemble the high softening point asphalts used in roofing applications which have softening points between about 170° F. and 220° F. The multilayered construction is to prevent these low softening point asphalts from exuding through the packaging during shipping and storage. In use, the asphalt and package are both added to the asphalt melter at the pavement compounding plant, and melted at a temperature between about 275° F. and 375° F., where bag material becomes incorporated into the paving compound (See col. 4, lines 53 to 70).

This packaging system, if applied to packaging for higher softening point roofing asphalts, would have the same problems as the system in U.S. Pat. No. 3,837,778, above. The melting temperature of the plastic packaging material is high and there would be insufficient time at too low a temperature to fully melt the packaging in an asphalt vat as conventionally used on a roofing job. The result is solid packaging residue in the asphalt melt. This problem is further aggravated by the high thickness of the film, up to 6 mils, which further increases the time required to melt the films.

In U.S. Pat. No. 2,964,176 to Lahr et al. is disclosed a packaging system for packaging hot meltable and sticky products, such as high melting point paraffins or bitumen. The system comprises a container consisting of a polypropylene which does not consolidate with the contents of the packaging and is stripped from the cooled contents.

OBJECTS OF THE INVENTION

It is, therefore, an object of the invention to provide a packaging for shipping roofing asphalt wherein no removal of the packaging is required before melting the asphalt at the job site.

It is further an object of the invention to provide a packaging for roofing asphalt which is fully compatible with asphalt and melts to form a homogeneous mass with the asphalt when the asphalt is melted in a asphalt vat.

It is further an object of the invention to provide a packaging for roofing asphalt wherein solid asphalt is packaged in units which can be easily handled and inserted in a conventional melting vat with no necessity to break up the solid asphalt mass or to remove any packaging material.

It is further an object of the invention to provide a packaging for roofing asphalt which can be easily stored and shipped on a shipping pallet with a minimum of empty space.

Further objects of the invention will become evident in the description below.

SUMMARY OF THE INVENTION

An embodiment of the invention is a package of roofing asphalt comprising a molded block of solid asphalt, the block contained in a flexible film, the film consisting essentially of polypropylene and being the sole containment means for the block, the film having a melting point between about 275° F. and about 335° F., for example, a melting point of 315° F. and a thickness between about 1.0 and 1.8 mils.

Another embodiment of the invention is a method for producing a shipping package of roofing asphalt comprising;

(a) providing a mold of a rigid material, (b) lining the mold with a flexible film, the film consisting essentially of polypropylene, the film having a melting point between about 275° F. to about 335° F. and a thickness between about 1.0 and 1.8 mils, (c) pouring liquid roofing asphalt into the film-lined mold, (d) cooling the mold to solidify the asphalt, and (e) removing the solidified asphalt covered with the flexible film to provide an asphalt package, the flexible film being the sole containment means for the solidified asphalt.

The roofing asphalt of the packaging of the invention is asphalt material typically used in roofing applications. Such materials have a melting point between about 170° F. and 220° F.

The flexible film is the sole containment means for the asphalt and consists essentially of polypropylene. It has been found that a flexible film of polypropylene which has the particular thickness and particular melting point recited above has the proper balance of strength for containing the liquid asphalt during the packaging operation and meltabilty to allow it to melt quickly and completely in a roofing asphalt vat used in the conventional manner.

DETAILED DESCRIPTION OF THE INVENTION

Figure 1:
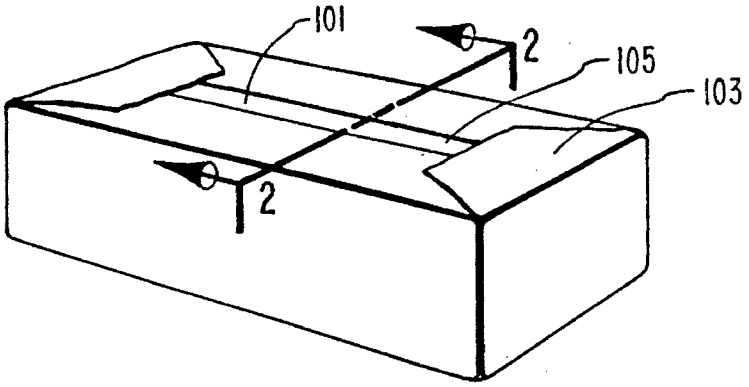
FIG. 1 is a perspective view of a package of roofing asphalt of the invention.
Figure 2:
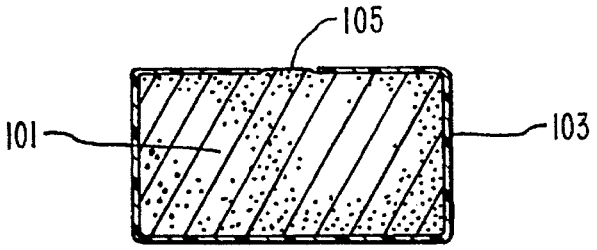
FIG. 2 is a cross-sectional view of a package of the invention as in FIG. 1.

Referring to FIG. 1, which is a perspective view of a package of the invention, and FIG. 2, which is a cross-sectional view through line 2—2 of FIG. 1, asphalt 101 is formed into a block, and is covered by polypropylene film 103. The asphalt 101 need not be completely covered by the film 101, but molding techniques usually required to form the package of the invention would generally require that the bottom and the four sides be covered.

Figure 3:
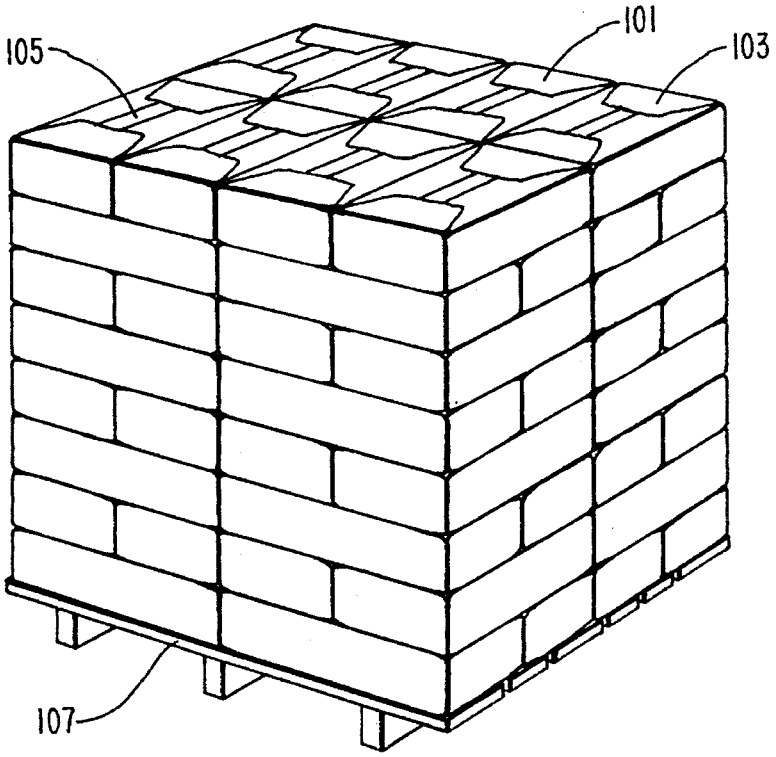
FIG. 3 is a perspective view of packages of the invention stacked upon a pallet.

The package of the invention is dimensioned to be convenient for storage, handling and insertion into a roofers asphalt vat. A preferred size is 22 inches long, 11 inches wide, and 6 inches high, resulting in a package with 50 pounds of asphalt. This size permits easy handling, and can be easily stacked for storage and shipping with little void space. In FIG. 3 is shown the stacking of packages of the invention 101 on a conventional shipping pallet 107. Referring to FIG. 1, the packaging of the invention preferably has a portion of the top surface 105 uncovered by the film to expose a surface of asphalt, preferably more than ¾ of the top surface is covered by the polypropylene film 103. For the above 22×11×6 package the exposed portion is about 1½×14 inches. When such packages are stacked on a pallet, the top asphalt surface of a package will adhere to the bottom of an adjacent package, stabilizing the stack. However, packages 101 may still be easily separated and removed when unstacked. The preferred size of the package also allows insertion of the whole package into an asphalt vat without having to cut or chop the package into smaller pieces. Its dimensions also allow the package to melt quickly in the vat. Since the film is not removed before inserting the package to the vat, there is no packaging waste and cleanup. The thin-walled polypropylene film material quickly melts with the asphalt and leaves no solid or partially melted residue in the asphalt melt.

Figure 4:
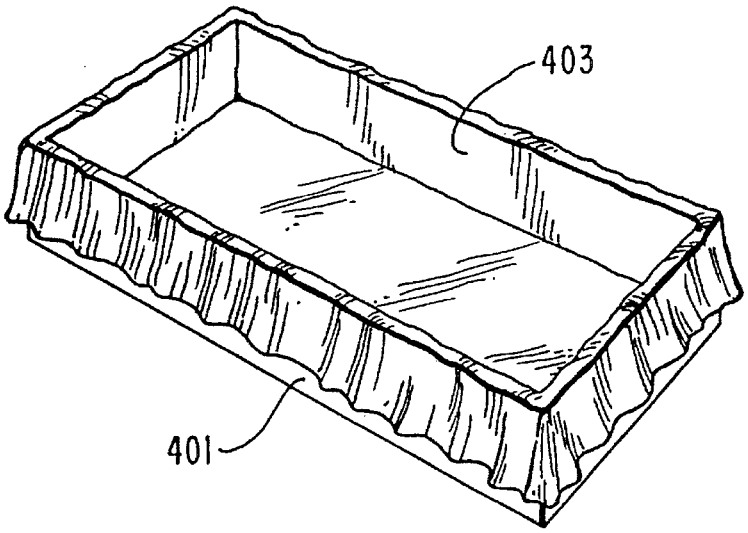
FIG. 4 is a simplified view of a mold used to form packages of the invention with a polypropylene film in the form of a bag in the mold.
Figure 5:
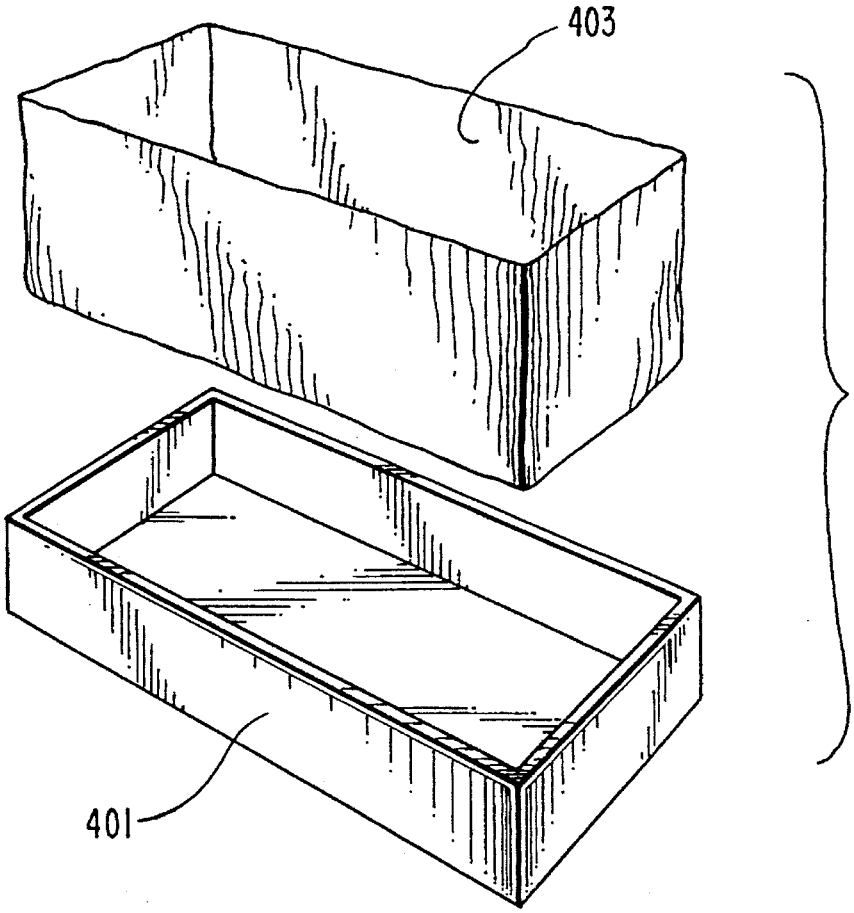
FIG. 5 is a simplified view of a mold used to form packages of the invention with a polypropylene film in the form of a bag prior to insertion into the mold.

The packages of the invention can be manufactured by any suitable method. Preferably, the packages are manufactured by providing a rigid, heat resistant mold, lining the mold with a polypropylene film, and pouring liquid asphalt into the lined mold. Such a mold 401 is illustrated in FIGS. 4 and 5. The polypropylene film 403 in FIG. 5 is inserted in the mold 401 as shown in FIG. 4, to line the mold 401 with polypropylene film 403. The mold 401 may be of any suitable material. Plastics, cellulosic materials, and the like, may be used if the mold is to be used once or only a few times. For more durable molds, a heat resistant plastic material, or preferably sheet or cast metal is used.

The polypropylene film 403 has the melting point and the thickness recited above. Higher melting point, and thicker materials do not completely melt in asphalt vat, while lower melting point, and thinner materials do not have the strength required for the manufacture of the packaging. The polypropylene film 403 may be in the form of a sheet or in the form of a bag, preferably dimensioned to be easily inserted into the mold 401 and also to cover all the surfaces of the mold to prevent the asphalt from adhering to the mold 401.

Figure 6:
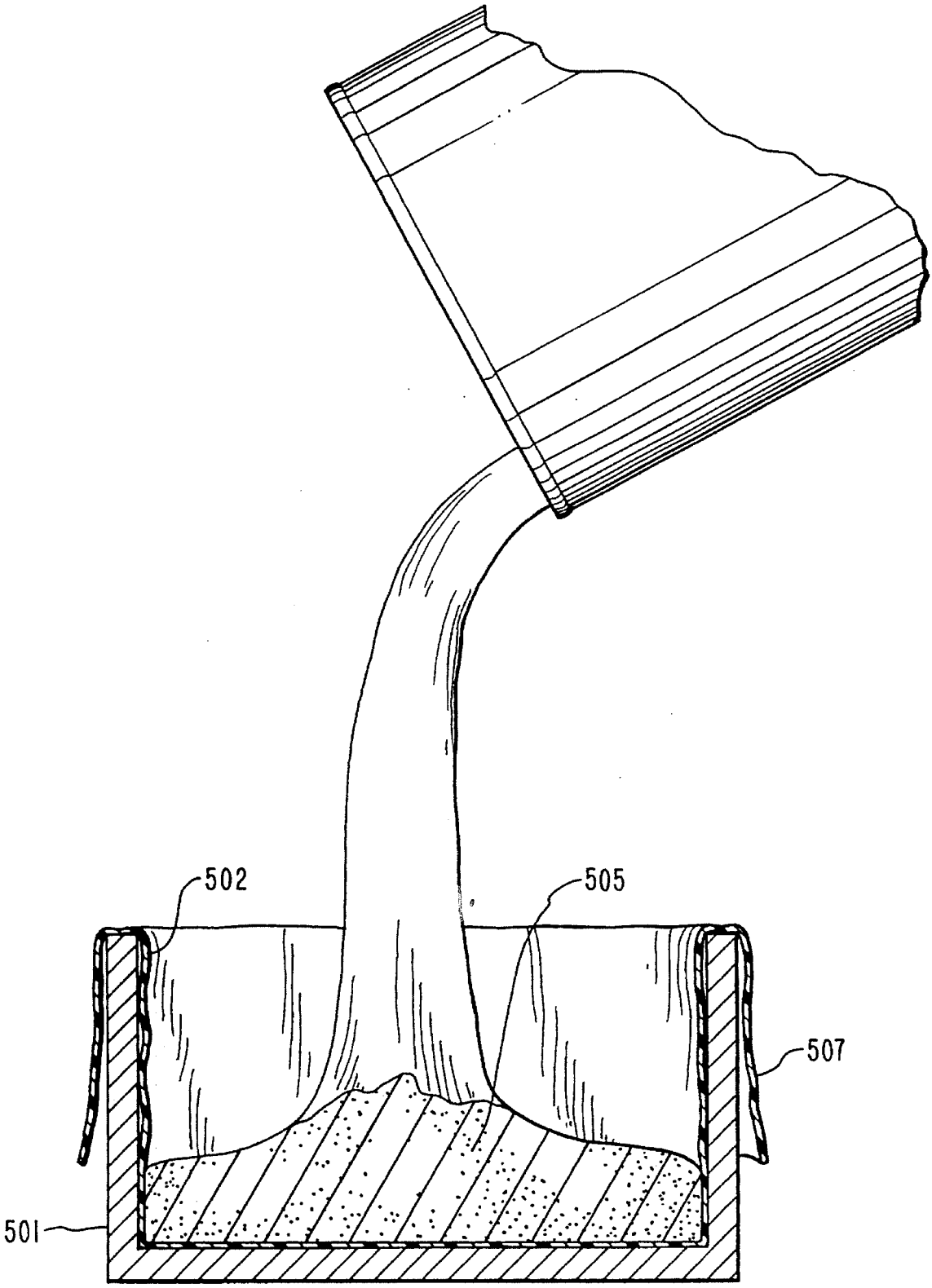
FIG. 6 is a cross-sectional view of the mold of FIG. 4 with liquid asphalt being poured into the mold.

Asphalt in a liquid form is poured into the mold. FIG. 6 is a cross-section showing mold 501, film 502 lining the mold, and asphalt 505 being poured into the mold 501. The asphalt is poured at a temperature between about 280° F. and 310° F. Below this temperature range the asphalt is too viscous, and above this, it may damage the film. The optimum temperature range is about 295° F.

After pouring the asphalt into the mold, the portion of the polypropylene film extending above the sides of the mold is folded over the top of the liquid asphalt (See 507 in FIG. 5). Preferably, the portion of the film folded over the top is sized to not completely cover the top of the package and leave an exposed surface of asphalt. The resulting package will have a top surface with the asphalt partially exposed as in FIG. 1.

The mold is then allowed to cool. A cooling means, e.g. a water bath, a jacketed mold, or the like, may be used to accelerate the cooling. A suitable method is to provide a trough containing water, with the molds placed in the trough to cool the molds. The molds with the melted asphalt are charged into one end of the trough and moved though the trough, e.g. by floating the molds or by a conveyor means, while the water cools the outer surface of the molds. The cooled molds with the solid asphalt are then discharged from the other end of the trough.

When the asphalt is sufficiently cool to be solid, the asphalt covered by the polypropylene film is removed from the mold. The polypropylene film covered asphalt brick is a packaging of the invention.

While this invention has been described with reference to certain specific embodiments and examples, it will be recognized by those skilled in the art that many variations are possible without departing from the scope and spirit of this invention, and that the invention, as described by the claims, is intended to cover all changes and modifications of the invention which do not depart from the spirit of the invention.

What is claimed is:

1. A package of roofing asphalt, consisting of:

a molded block of roofing asphalt, said roofing asphalt having a melting point between about 170° F. and 220° F.; and a container for the molded block of roofing asphalt, said container consisting solely of a flexible film which consists essentially of polypropylene and which has a thickness of between about 1.0 and 1.8 mils and a melting point between about 275° F. and 335° F.

2. A stacked plurality stacked of packaged roofing asphalt comprising: a plurality of roofing asphalt packages stacked on a pallet, each package in adhesive contact with an adjacent package, each package consisting essentially of a container and a molded block of solid roofing asphalt; said roofing asphalt having a melting point between about 170° F. and 220° F.; said container consisting solely of a single sheet of polypropylene film having a thickness of between about 1.0 and 1.8 mils anal a melting point between about 275° F. and 335° F.

* * * * *